United States Patent [19]

Le Meur et al.

[11] Patent Number: 4,723,486

[45] Date of Patent: Feb. 9, 1988

[54] DEVICE FOR AUTOMATIC ANGULAR POSITIONING OF A PLURALITY OF INDEXABLE ROTARY MACHINE ELEMENTS, AND A MACHINE COMPRISING A DEVICE OF THIS TYPE, ESPECIALLY A POSTAL FRANKING MACHINE

[75] Inventors: Germain Le Meur, Stains; Claude R. Martin, St. Germain en Laye, both of France

[73] Assignee: Societe d'Etude et de Construction d'appareils de precision (S.E.C.A.P.), Boulogne Billancourt, France

[21] Appl. No.: 794,395

[22] Filed: Nov. 4, 1985

[30] Foreign Application Priority Data

Nov. 5, 1984 [FR] France ..... 84 16785

[51] Int. Cl.[4] ..... B41J 5/00; B41L 47/62

[52] U.S. Cl. ..... 101/91; 101/110; 74/424.8 NA; 74/354

[58] Field of Search ..... 74/354, 57, 384, 337.5, 74/322–324, 371, 372, 424.8 NA, 31; 101/110, 92, 91

[56] References Cited

U.S. PATENT DOCUMENTS

| | | | |
|---|---|---|---|
| 2,768,532 | 10/1956 | Russell | 74/424.8 NA |
| 2,809,688 | 10/1957 | Brundage | 74/424.8 NA |
| 2,832,773 | 5/1975 | Cook et al. | 101/110 |
| 2,966,077 | 12/1960 | Wise | 74/424.8 NA |
| 3,357,271 | 12/1967 | Nuenberg | 74/31 |
| 3,572,239 | 3/1971 | Grenier | 101/110 |
| 3,682,282 | 8/1972 | Cochoni et al. | 101/111 |
| 4,448,122 | 5/1984 | Holland-Letz | 101/110 |
| 4,598,639 | 7/1986 | Sette | 101/91 |

FOREIGN PATENT DOCUMENTS

| | | | |
|---|---|---|---|
| 64963 | 11/1982 | European Pat. Off. | 101/110 |
| 90706 | 10/1983 | European Pat. Off. | 101/110 |
| 2355659 | 1/1978 | France | 101/91 |
| 820464 | 9/1959 | United Kingdom | 101/110 |
| 889065 | 2/1962 | United Kingdom | 101/110 |

*Primary Examiner*—William Pieprz

*Attorney, Agent, or Firm*—Jones, Day, Reavis & Pogue

[57] ABSTRACT

A device for automatic angular positioning of indexable rotary elements, especially for postal franking machines and the like comprises a common indexing-control gearwheel rigidly fixed to a cylindrical indexing-control rod, and an indexing-control rotating primary shaft which forms a ball cage. The balls are engaged in an annular groove of a shaft bearing and in helical grooves of the control rod which can be temporarily locked either against rotational motion or against sliding motion, a support being provided for the bearing and capable of moving towards the series of indexable rotary elements.

7 Claims, 9 Drawing Figures

DEVICE FOR AUTOMATIC ANGULAR POSITIONING OF A PLURALITY OF INDEXABLE ROTARY MACHINE ELEMENTS, AND A MACHINE COMPRISING A DEVICE OF THIS TYPE, ESPECIALLY A POSTAL FRANKING MACHINE

BACKGROUND OF THE INVENTION

1. Field of the Invention

This invention relates to devices for automatic angular positioning of indexable rotary machine elements, especially for office machines, packaging machines and, more generally, machines in which it is necessary to adjust the angular position of one or a number of elements.

The invention is primarily applicable to automatic positioning of printing wheels in a postal franking machine, the printing drum of the machine being so designed as to constitute a rotary support for the printing wheels, indexing of which permits "value-setting" of the machine for each franking operation.

2. Description of the Prior Art

A machine of this type can comprise a frame, a main shaft rotatably mounted in the frame, a printing drum which is carried by said shaft and in which printing wheels are rotatably mounted on a cross-shaft and are adapted to carry toothed pinions each disposed in meshing engagement with a first corresponding toothed rack rigidly fixed to a bar which is mounted for longitudinal sliding motion within said main shaft whilst a second longitudinal toothed rack rigidly fixed to each slide-bar aforesaid is disposed in meshing engagement with one of a number of individual coaxial value-setting toothed wheels or so-called gear-wheels.

In some known devices and in particular the device described in U.S. Pat. No. 4,398,458, each slide-bar is actuated by a stepping motor. In order to ensure that it can readily be housed inside the machine, each stepping motor must be of small size and is therefore capable of producing only a low torque. This gives rise to a potential danger of interruptions caused by loss of step when the slide-bars and gear-wheels are hindered in their movement by the printing ink, thus entailing the need for frequent cleaning. Moreover, the axial arrangement of the slide-bars makes it necessary to provide complicated transmission systems between these latter and the printing wheels.

In other devices of the described, for example, in U.S. Pat. No. 3,965,815, the printing wheels are positioned by independent pinions which are engaged successively with a gear-wheel. The gear-wheel is rotatably mounted in a carriage which is capable of displacement in a direction parallel to the common axis of the pinions, said gear-wheel being driven by a single stepping motor. Displacement of the carriage is produced by two electromagnets which are energized either together or separately in order to cause pivotal displacement of levers connected to the carriage by means of a shaft which converts the movement of rotation to a movement of translation. In this design, there remain a large number of mechanical couplings, the inertia of which limits the speed of movements and makes it necessary to provide two electromagnets of large size. Finally, the number of positions of the carriage is limited to four positions representing the combinations of two electromagnets having two states.

In other devices of the type described, for example, in U.S. Pat. No. 4,050,374 (French Pat. No. 2,355,659), the slide-bars are actuated successively by a first stepping motor and the shaft of this motor slidably supports a carriage which is driven transversely by a second stepping motor. In spite of its simple design, the second stepping motor is both cumbersome and costly.

SUMMARY OF THE INVENTION

The aim of the invention is to provide an automatic device for positioning indexable rotary machine elements and especially printing wheels of a postal franking machine, said device being unattended by the above-mentioned disadvantages of the forms of construction recalled in the foregoing.

To this end, the device in accordance with the invention comprises:

- a common indexing-control gear-wheel rigidly fixed to a cylindrical indexing-control rod which is parallel to the axis of said indexable rotary elements,
- a rotating primary shaft for indexing control constituted by a cylindrical sleeve forming a ball cage, the cylindrical control rod aforesaid being capable of displacement in sliding and rotational motion within the bore of said ball cage,
- a bearing for the rotating primary shaft, said bearing being carried by a support which is capable of moving solely in the direction of the series of indexable rotary elements, the bore of said support being provided with an annular groove and the balls aforesaid being partially engaged in said annular groove as well as in helical grooves formed in the cylindrical surface of said cylindrical control rod,
- an electric stepping motor, the shaft of said motor being rotationally coupled to the indexing-control rotating primary shaft,
- locking-arms elastically applied respectively against the sets of gear-teeth of the indexable rotary elements,
- means for temporarily locking the indexing control rod solely against rotational motion,
- means for temporarily locking the indexing control rod solely against sliding motion,
- means for temporarily thrusting-back the arm for locking the indexable rotary element which is disposed in meshing engagement with the common indexing-control gear-wheel and for angularly locking the other indexable rotary elements at the same time,
- means for controlling the displacements of the support aforesaid in such a manner as to ensure that a movement of rotation of the stepping motor produces either an axial displacement of the rotationally locked cylindrical rod and common gear-wheel for selecting the rotary element to be indexed or a rotational displacement of the translationally locked cylindrical rod and common gear-wheel for indexing the selected rotary element.

By virtue of this particular design concept, it is possible to construct a device which is reliable, economical and of small overall size.

The invention is also directed to machines and especially postal franking machines comprising a device for automatic angular positioning of indexable rotary elements having the characteristics which are set forth in this patent specification.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
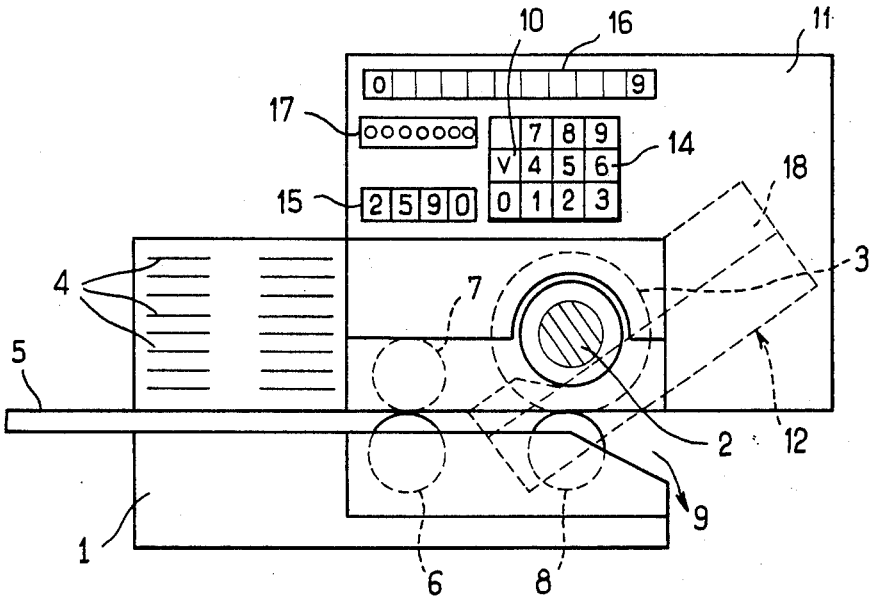
FIG. 1 is a front view of a postal franking machine in which the printing wheels are set at the requisite value by an automatic device in accordance with the invention.

The postal franking machine as shown in a general front view in FIG. 1 comprises a frame 1 in which is rotatably mounted a main shaft 2 which supports a printing drum 3. The mail envelopes and wrappers 4 to be franked are placed on a table 5 which is rigidly fixed to the frame 1, are thrust one by one between two conveying-rollers 6, 7, then transferred by said rollers between the rotary printing drum 3 and a bearing roller 8. The franked envelopes and wrappers are discharged from the machine at the location indicated by the arrow 9. The printing drum is driven in rotation, each time for one revolution, by a motor which will be described hereinafter in greater detail. A casing 11 encloses the device for value-setting of the printing wheels which is generally designated by the reference numeral 12 and will hereinafter be described in detail. The casing also encloses in particular the elements for control and reading such as a keyboard 14, a franking or prepayment value indicator 15, a prepayment-value integrating counter 16, and a franked-envelope counter 17. The movements of the different elements of the automatic value-setting device are carried out by an electric stepping motor 18 and by an electromagnet (not shown in this figure) in response to the data supplied to the keyboard under the control of an electronic assembly comprising a microprocessor and peripherals (not shown) which will not be described in detail since this assembly does not form part of the invention.

Figure 2:
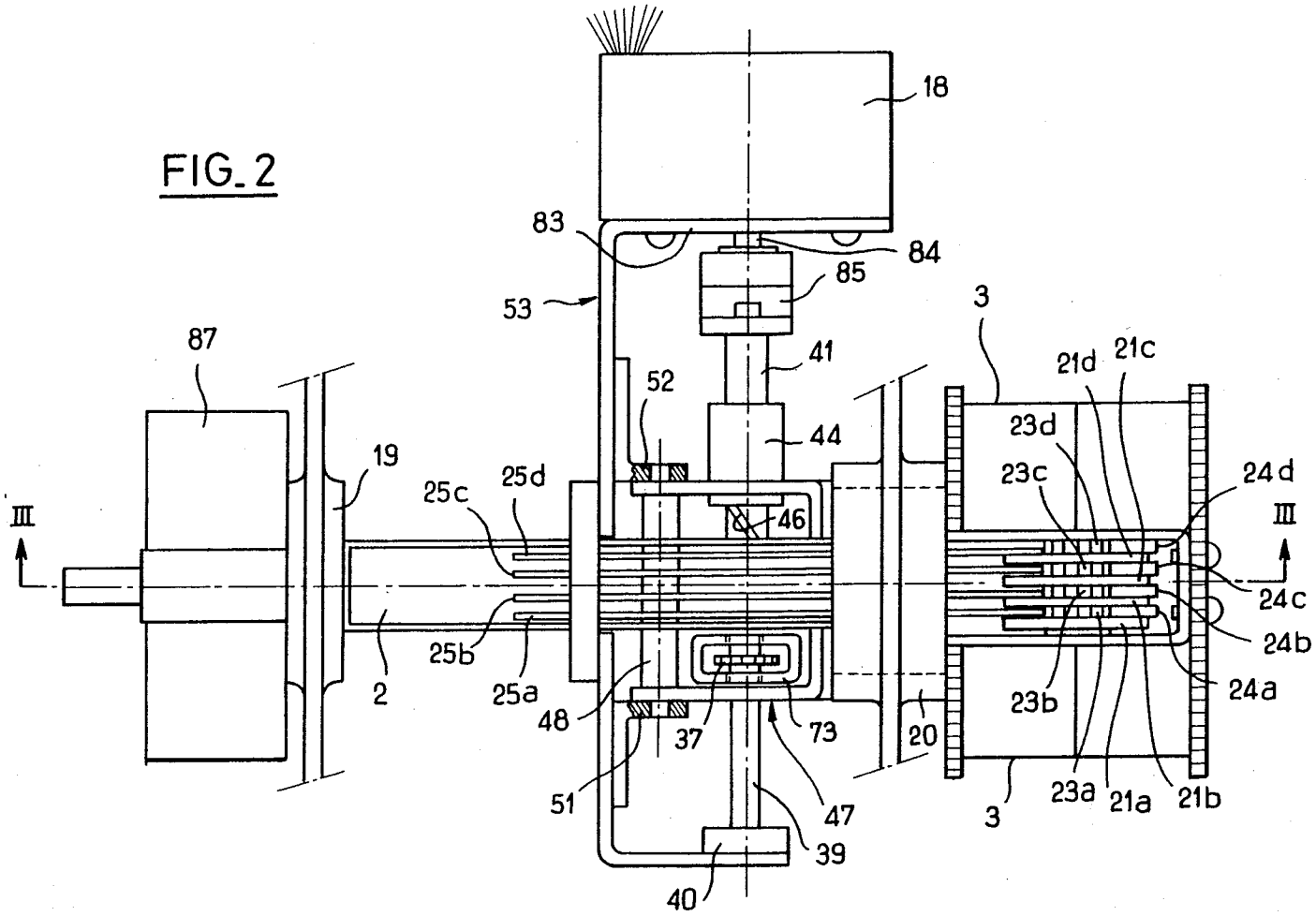
FIG. 2 is a plan view of the printing-wheel value-setting device in the inactive position.
Figure 3:
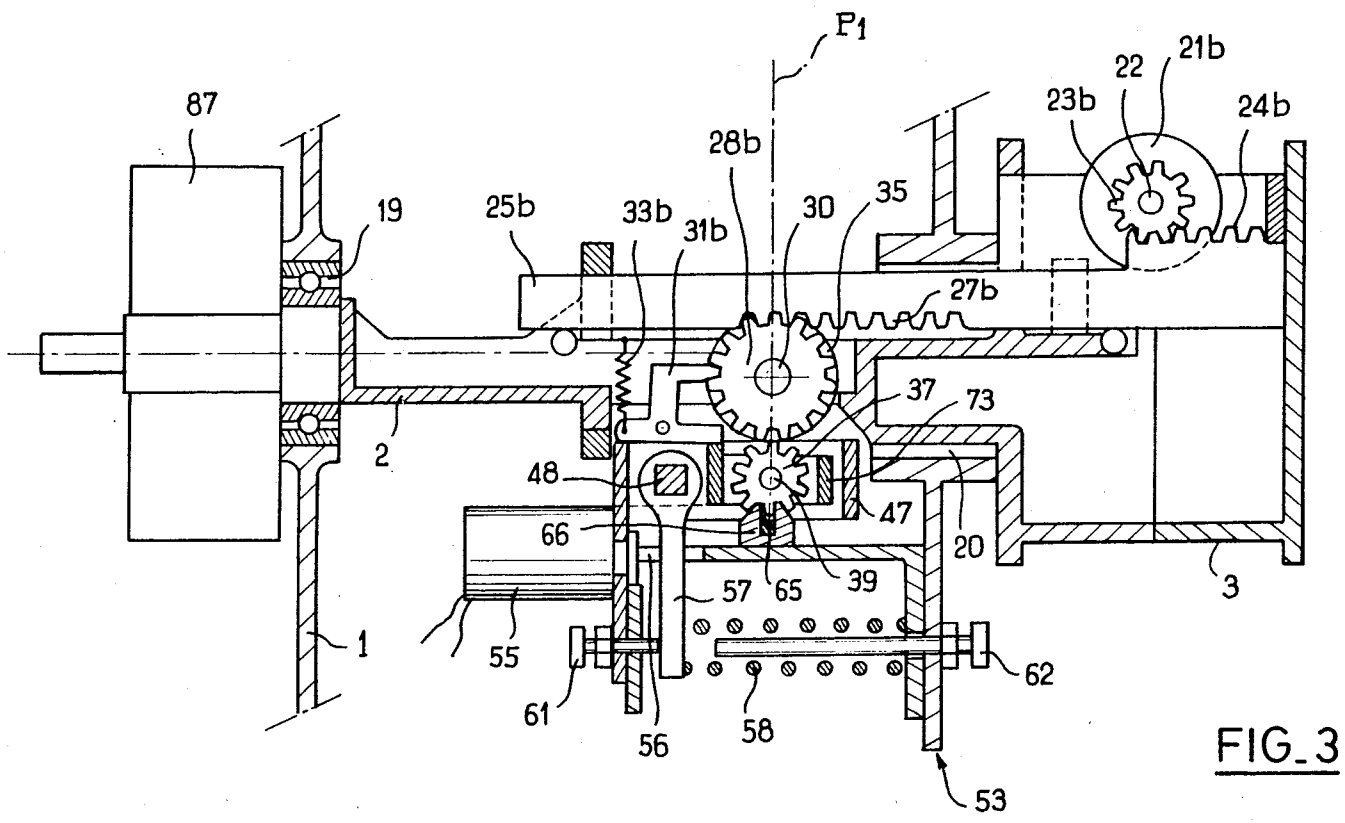
FIG. 3 is a vertical sectional view taken along line III—III of FIG. 2.
Figure 4:
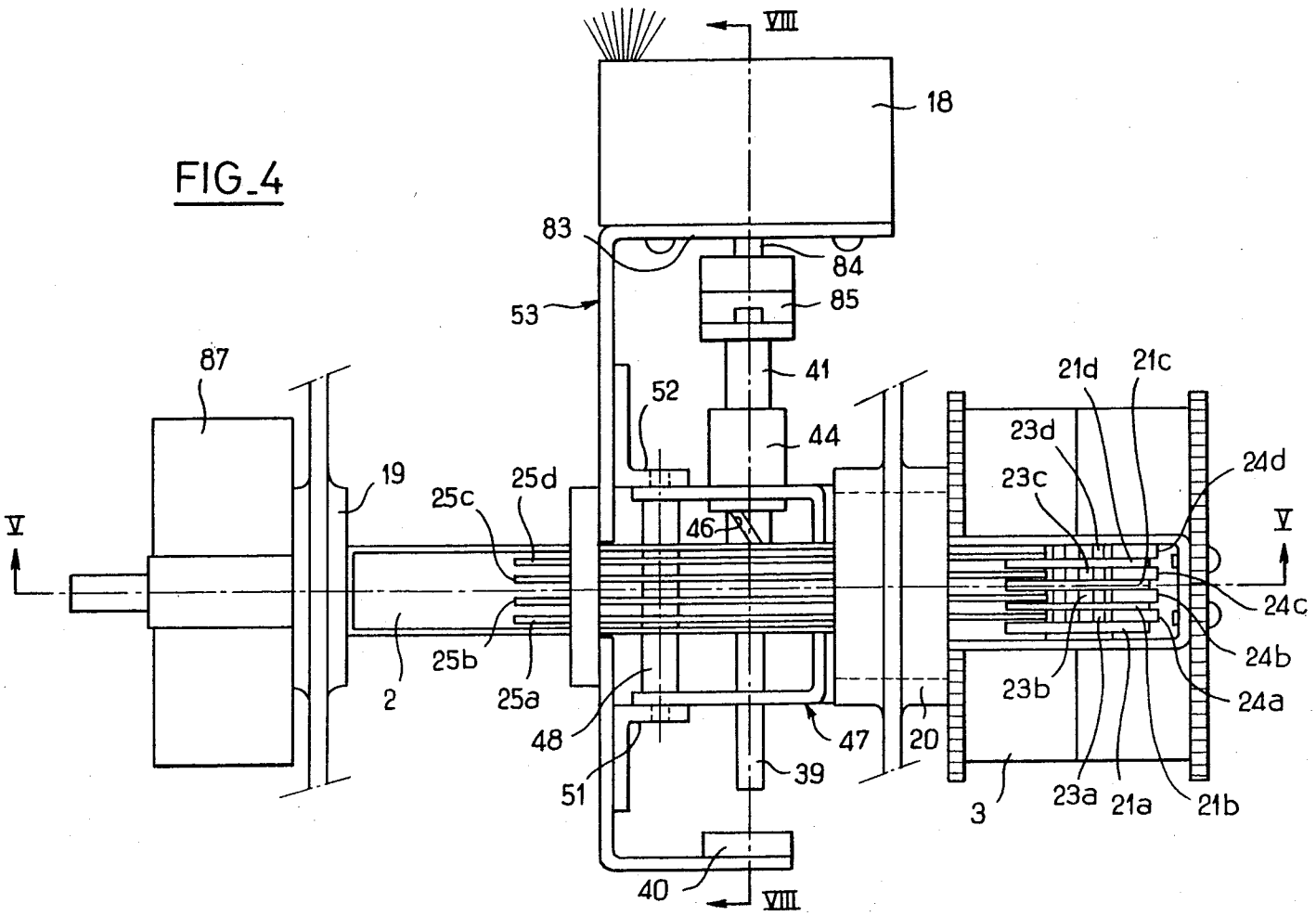
FIG. 4 is a view which is similar to FIG. 2 but in which the device is in the position corresponding to value-setting of a printing wheel.

FIGS. 2 and 3 illustrate to a larger scale the main shaft 2 which is rotatably mounted in two bearings 19, 20 and supports the drum 3 in which are mounted the printing wheels 21*a*, 21*b*, 21*c*, 21*d*. By way of example, provision is made for four printing wheels corresponding to the units, tens, hundreds and thousands of the prepayment or franking values to be printed. These wheels are freely mounted for rotation on a shaft 22 extending at right angles to the direction of the main shaft 2 and are rigidly fixed respectively to toothed pinions 23*a*, 23*b*, 23*c*, 23*d*, the teeth of said pinions being disposed respectively in mesh with first toothed racks 24*a*, 24*b*, 24*c*, 24*d* which are rigidly fixed to longitudinal bars 25*a*, 25*b*, 25*c*, 25*d* adapted to slide within corresponding grooves cut in the main shaft 2.

Figure 8:
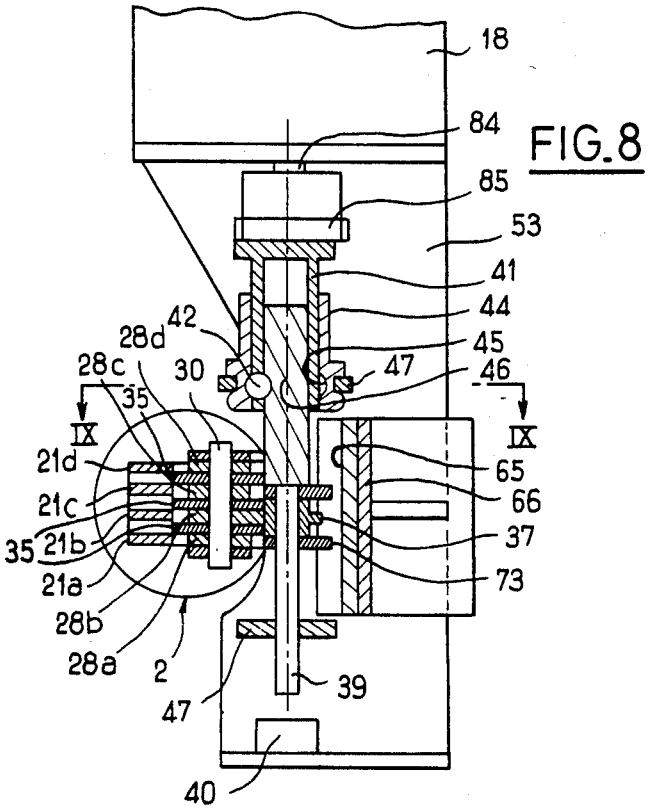
FIG. 8 is a sectional view taken along line VIII—VIII of FIG. 4.

Each slide-bar such as the bar 25*b*, for example, is provided with a second toothed rack 27*b* which is in turn disposed in meshing engagement with an indexable rotary element consisting of an individual value-setting control gear-wheel 28*b* (as also shown in FIG. 8). In the case under consideration in which the machine comprises four printing wheels, there are therefore four individual value-setting control gear-wheels 28*a*, 28*b*, 28*c*, 28*d* respectively. In order to simplify the illustration, however, only three value-setting gear-wheels 28*a*, 28*b*, 28*c* are shown in the large-scale view of FIG. 7. These toothed wheels are loosely mounted on a shaft 30 fixed transversely within the main shaft 2 in a direction parallel to that of the shaft 22 which carries the printing wheels. Said gear-wheels are locked in each of their positions which correspond to numerals in the printing position of the printing wheels by means of locking-arms such as the arm 31*b* (FIG. 6) in the case of the gear-wheel 28*b*. All of the locking-arms are pivotally mounted on a common cross-shaft 32 carried by the main shaft 2 and are restored elastically against the gear-wheel teeth by springs such as the spring 33*b*. Between the individual value-setting control gear-wheels are interposed washers 35 having an external diameter equal to the diameter of the addendum circle of said gear-wheels or in other words the diameter of the circumference which passes through the tops of the gear-teeth. Further reference will be made hereinafter to the intended function of these washers.

Figure 9:
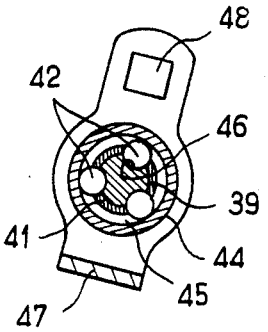
FIG. 9 is a sectional view taken along line IX—IX of FIG. 8.

A common indexing or value-setting gear-wheel 37 can be selectively engaged with each of the individual value-setting control gear-wheels 28*a* to 28*d*. As shown in particular in FIGS. 6 to 8, said value-setting gear-wheel 37 is rigidly fixed, for example by means of a locking-pin 38, to a cylindrical rod 39 for indexing or value-setting control. Said rod 39 is located in the same transverse geometrical plane P1 as the axis of the individual gear-wheels 28*a* to 28*d* and parallel to said axis. As shown in FIGS. 8 and 9, one end of said rod 39 is mounted in a rotating primary shaft 41 for indexing or value-setting control, this shaft being constituted by a cylindrical sleeve which forms a ball cage 42 and within which said rod 39 is capable of rotation and of longitudinal displacement in sliding motion. The amplitude of sliding motion of the rod 39 is limited by an adjustable stop 40. The primary shaft 41 is mounted in a bearing 44, an annular groove 45 being formed in the bore of said bearing. The balls are partially engaged in said annular groove as well as in helical grooves 46 formed in the cylindrical surface of the rod 39. The bearing 44 is mounted in a support 47 which is capable of moving either towards or away from the set of individual value-setting control gear-wheels 28*a* to 28*d* by means of a pivotal movement of a shaft 48, the two ends of which are mounted respectively in two brackets 51, 52, said brackets being rigidly fixed to a structure 53 which in turn is removably fixed within the frame 1. The other end of the rod 39 is capable of rotating and of sliding freely within the support 47. Said support 47 is capable of pivotal displacement under the action of an electromagnet 55 (shown in FIG. 5) which is supported by the structure 53 and the moving armature 56 of which is adapted to thrust-back an arm 57 which is rigidly fixed to the support 47, in opposition to the force of a restoring spring 58. The amplitude of the movements of oscillation of the arm 57 is limited, with precision, by two adjustable stop-screws and locknuts 61, 62.

Figure 7:
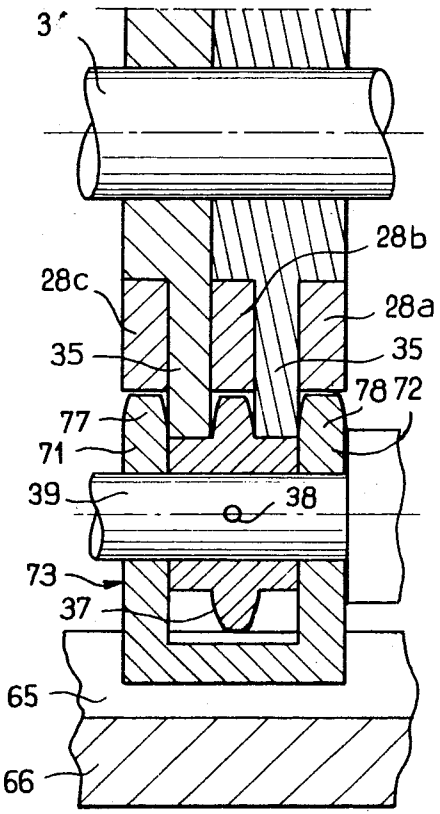
FIG. 7 is a sectional view taken along line VII—VII of FIG. 6.
Figure 6:
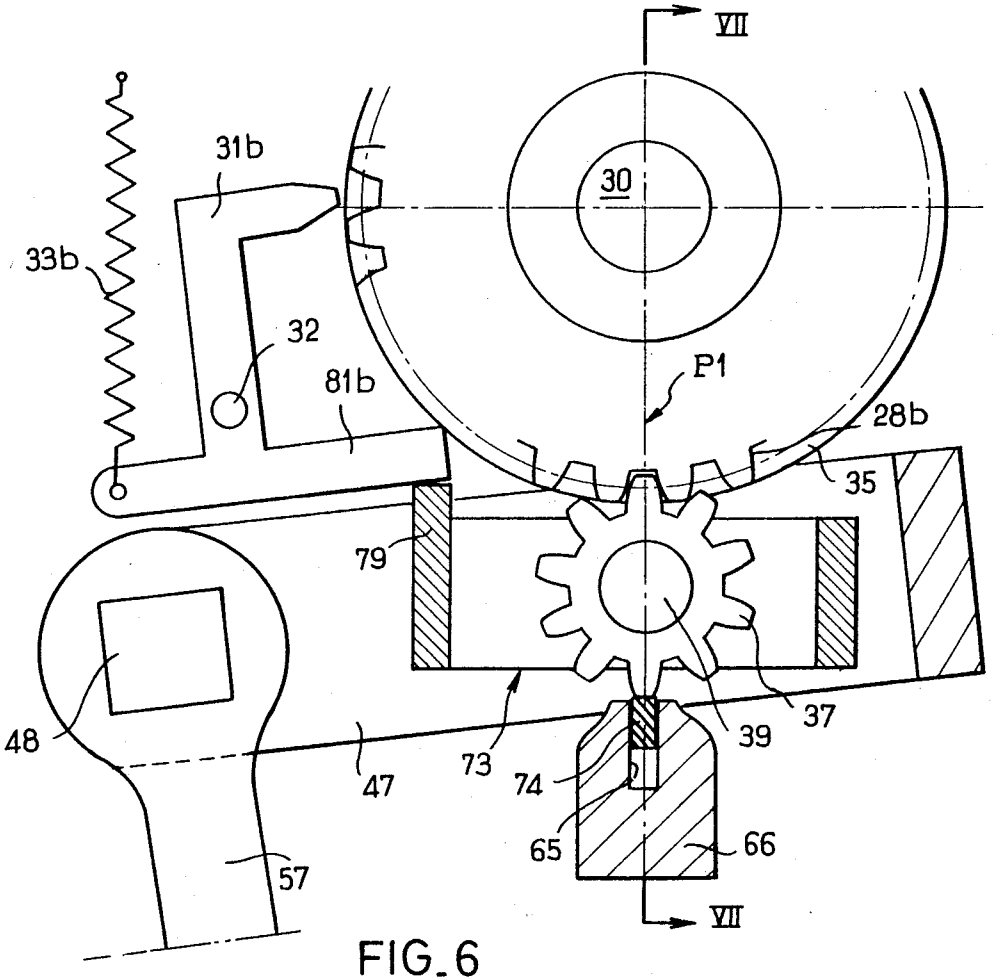
FIG. 6 is a view to a larger scale showing the central portion of FIG. 5.

When the support 47 occupies its inactive bottom position as shown in FIGS. 2 and 3, one tooth of the common value-setting control gear-wheel 37 is engaged in a groove 65 (as also shown in FIGS. 6 and 7) which is parallel to the axis of said gear-wheel and formed in a guide 66 carried by the structure 53. As a result of this engagement, the rod 39 which is rigidly fixed to said gear-wheel is keyed rotationally. In this same position, the locking-arms such as the arm 31*b* which are restored elastically by the springs such as the spring 33*b* produce a rotational keying or locking action on all the individual value-setting control gear-wheels.

When the support 47 occupies its top active position as shown in FIGS. 4 to 8, the common value-setting control gear-wheel 37 is withdrawn from the groove 65. In addition, the common gear-wheel 37 is engaged between the two washers 35 which are located on each side of the individual gear-wheel against which the common gear-wheel is engaged, with the result that said common gear-wheel 37 and the rod 39 are locked translationally. The result thereby achieved is that a movement of rotation of the rod 39 is capable of causing said gear-wheel to rotate and consequently of indexing the individual gear-wheel and the corresponding printing-wheel. Means are also provided for selectively withdrawing the locking-arm such as the arm 31*b* which locks the individual gear-wheel considered. Moreover, safety means are provided for additional axial and/or angular locking respectively of the rod 39 and/or of the individual gear-wheels other than the gear-wheel at present selected, for example the gear-wheel 28*b*. To this end, the two cheeks 71, 72 of a supporting yoke 73 are traversed by the value-setting control rod 39 and embrace the common gear-wheel 37. The yoke 73 is provided with a rib 74 and this latter is continuously engaged within a guide groove which, in this example, is constituted by the groove 65 in which one tooth of the common gear-wheel is already capable of engaging.

When the supporting yoke 73 is located in the bottom position, the rib 74 of the yoke is engaged in the bottom of the groove and one tooth of the common gear-wheel 37 is engaged in the top portion of said groove. In the top position of the supporting yoke, however, the tooth of the common gear-wheel is withdrawn from the groove but the rib of the yoke is still engaged in the upper portion of the groove. In addition, portions of gear-teeth 77, 78 of the two cheeks 71, 72 of the yoke respectively are in axial contact with at least one of the washers 35 and are engaged in the sets of teeth of the two individual gear-wheels 28*a*, 28*c* which are located on each side of the selected individual gear-wheel 28*b* and consequently which are positively locked rotationally whilst the rod 39 is locked translationally: Finally, a projecting portion 79 of the yoke 73 in the top position exerts a thrust on an elbowed extension 81*b*, for example, of the corresponding locking-arm 31*b*, for example, thereby unlocking the selected individual gear-wheel 28*b* in order to permit indexing of this latter.

The electric stepping motor 18 (shown in FIGS. 1, 2, 4) is secured to a console 83 which is rigidly fixed to the frame of the machine. The shaft 84 of said motor is coupled to the primary shaft 41 by means of a universal joint such as an Oldham coupling or Cardan joint, for example, as indicated at 85.

The motor for driving in rotation for one revolution the main shaft 2 which carries the printing drum is indicated at 87.

The operation of the machine is as follows:

After the last envelope-franking operation, the printing-wheels 21*a*, 21*b*, 21*c*, 21*d* have remained at their respective values Va-0, Vb-0, Vc-0 and Vd-0. Let it be supposed that the next operation consists in franking an envelope at a different value which makes it necessary to index at least a certain number of the printing-wheels at a new value. The values which the printing-wheels must now have will be designated as Va-1, Vb-1, Vc-1 and Vd-1.

At the present moment, the machine is at rest and the different elements of the automatic value-setting control device occupy the positions shown in FIGS. 2 and 3. In other words, the common value-setting control gear-wheel 37 is out of reach of the individual gear-wheels 28*a*, 28*b*, 28*c*, 28*d* by reason of the fact that the rod 39 occupies its position of maximum advance against the stop 40. Furthermore, the electromagnet 55 is not energized, with the result that the supporting yoke 73 occupies its bottom position and that one tooth of the common gear-wheel 37 is therefore engaged within the groove 65. In consequence, the rod 39 which is rigidly fixed to said gear-wheel is locked rotationally.

Figure 5:
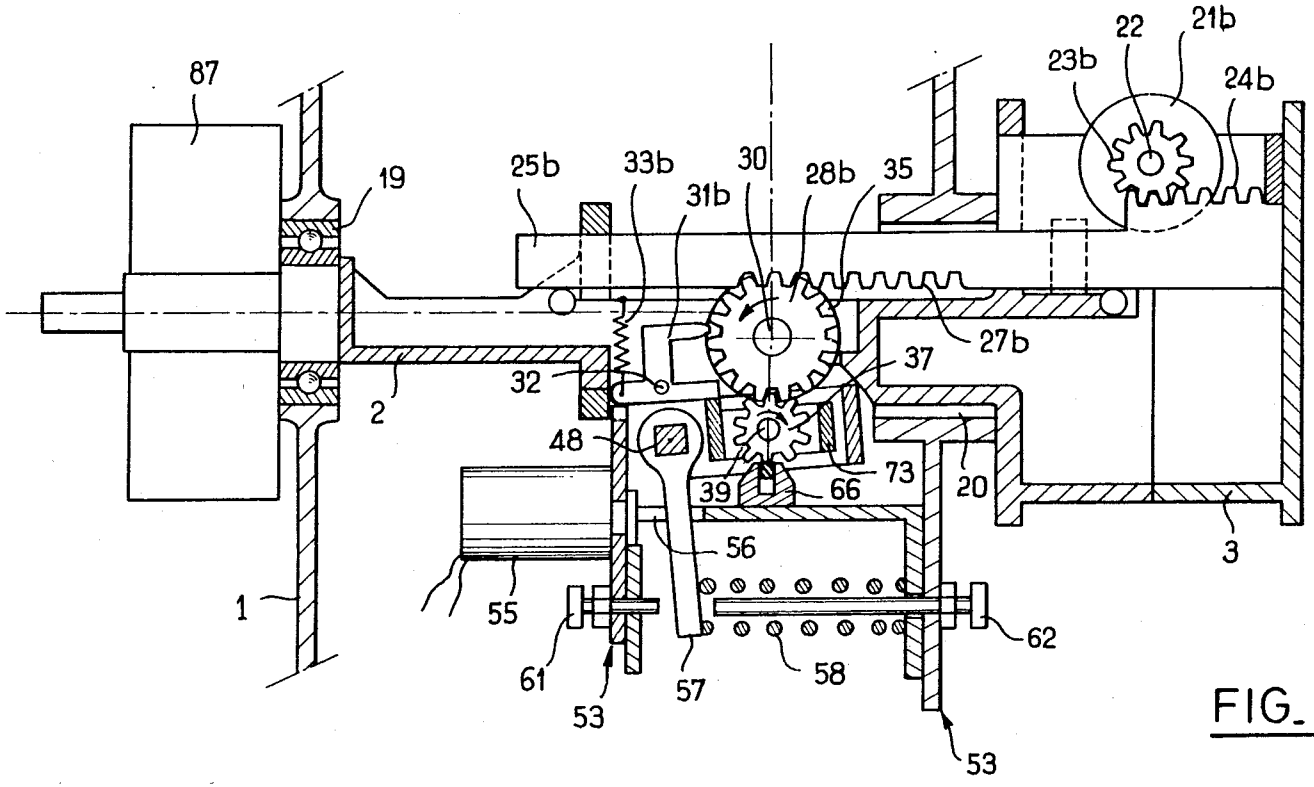
FIG. 5 is a vertical sectional view taken along line V—V of FIG. 4.

The new franking value is set up on the keyboard 14 (as shown in FIG. 1). This new value appears in the counter window 16. The key "V" designated by the reference numeral 10 in FIG. 1 is then depressed. From this instant, all the operations for value-setting of the printing-wheels will take place under the control of the electronic microprocessor device by carrying out the following series of sequences:

the stepping motor 18 is started-up in the appropriate direction and for the appropriate number of steps in order to ensure that the rod 39 which is shown in FIGS. 4 to 9 (and is locked rotationally as has just been recalled) is subjected to a sliding movement in the backward direction away from the stop 40. The common gear-wheel 37 is consequently brought into position opposite to the first individual gear-wheel 28*a* as a result of rotation of the ring of balls 42. The balls are imprisoned within the thickness of the tubular primary shaft 41 which is coupled to the motor shaft 84 and are partially engaged both in the helical grooves 46 of the rod 39 and in the annular groove 45 of the fixed bearing. Since the rod 39 cannot rotate, it must necessarily slide in the axial direction;

the supply of current to the electromagnet 55 produces a displacement of its armature 56 and a pivotal movement of the arm 57 up to the stop 62 (shown in FIG. 5). This in turn produces an upward displacement of the support 47, thus causing engagement of the common gear-wheel 37 in the individual gear-wheel 28*a* (reference can be made to FIGS. 6 and 7 which correspond to selection of the individual gear-wheel 28*b*) and disengagement of said gear-wheel 37 from the fixed groove 65 as well as disengagement of the locking-arm 31*a* from said individual gear-wheel and, on the contrary, locking of the following individual gear-wheel 28*b* in which the portion of gear-teeth 77 of the yoke 73 is engaged. The rod 39 is maintained stationary against translational motion by virtue of the fact that the cheek 71 of the yoke 73 is embraced by the washers 35 which are threaded on the shaft 30 on each side of the individual gear-wheel 28*b* and the fact that said individual gear-wheel is carried by the main shaft 2 of the machine which, in accordance with conventional practice, is always locked rotationally in a predetermined standby position between two franking operations;

the stepping motor 18 is started-up in the appropriate direction and for the appropriate number of steps in order to ensure that the rod 39 (locked translationally) is subjected to a movement of rotation having an amplitude such that the individual gear-wheel 28*a* has the effect of changing the printing-wheel 21*a* from the value Va-0 to the value Va-1 by means of the kinematic chain which comprises the toothed rack 27*a*, the rod 25*a*, the toothed rack 24*a* and the toothed pinion 23*a*. The rod 39 can in fact only rotate about its own axis under the influence of the movement of rotation of the primary shaft 41 which causes displacement of the balls 42 in a circular movement within the groove 45 of the fixed bearing ;

the current supply to the electromagnet 55 is cut-off (FIG. 3), the arm 57 is thrust-back by the spring 58, the support 47 moves downwards, the common gear-wheel 37 withdraws from the individual gear-wheel 28*a*, the portion of gear-teeth 77 withdraws from the individual gear-wheel 28*b* and the locking-arm 31*a* engages in the individual gear-wheel 28*a* which has just been indexed. At the same time, the common toothed wheel 37 again engages in the fixed locking groove 65;

the same sequences as those just described in detail for the indexing of the first printing-wheel 21*a* are repeated for the indexing of each of the other printing-wheels 21*b*, 21*c* and 21*d*. It is nevertheless wholly apparent that, if the franking or prepayment value of one or a number of printing-wheels does not need to be modified, the sequences which correspond to value-setting of said printing-wheels do not take place.

In the position in which the common gear-wheel 37 is located opposite to the second individual gear-wheel 28*b* (which is the case illustrated in FIGS. 6 to 8), said common gear-wheel 37 is imprisoned axially between the two washers 35 located on each side of the individual gear-wheel 28*b* while the two gear-teeth portions 77 and 78 of the yoke 73 are in meshing engagement with the two individual gear-wheels 28*a* and 28*c* respectively and embrace the aforesaid pair of washers 35. In regard to the other axial positions of the common gear-wheel for selecting individual gear-wheels 28*c* and 28*d*, it is clearly necessary to transpose the relative positions of the various elements to be taken into consideration;

when all the printing-wheels are located in their desired franking positions, the stepping motor 18 is started-up in the appropriate direction and for the appropriate number of steps in order to ensure that the rod 39 which at that time is locked rotationally by the common gear-wheel 37 is returned to its advanced position against the stop 40 (as shown in FIGS. 2 and 3). In consequence, the common gear-wheel 37 is once again located at a distance from the group of individual gear-wheels 28*a* to 28*d*;

the main shaft is driven in rotation for one revolution under the action of the motor 87 as soon as the envelope to be franked is introduced into the machine. The counter 17 (shown in FIG. 1) advances by one unit and the total of the values of the envelopes already franked appears in the counter window 16.

The machine is ready for franking another envelope at the same value. Should it be necessary to modify the franking (prepayment) value, the operations described in detail in the foregoing would then be carried out.

In order to simplify the construction of the machine, to facilitate programming of its microprocessor and to reduce inertia forces, the common value-setting control gear-wheel 37 is advantageously provided with a number of teeth equal to ten. At the same time, the axial spacing between the individual gear-wheels 28*a* to 28*d* is chosen so as to be equal to one-tenth of the pitch of the helical grooves 46 of the rod 39, thereby ensuring that the number of rotational steps to be performed by the rotor of the motor 18 is the same for an operation involving axial selection of an individual gear-wheel as for indexing of one tooth of said gear-wheels.

It will be readily apparent that the invention is not limited to the preferential embodiment hereinabove described but is more generally applicable to selection and indexing of moving parts provided with gear-teeth having aligned motion-transmission means.

What is claimed is:

1. In a postal franking machine comprising:

a frame, a printing drum, a main shaft rotatably mounted in said frame and carrying said printing drum, printing wheels rotatably mounted in said printing drum, an auxiliary shaft carried by said main shaft at right angles relative thereto, a plurality of indexable toothed machine elements rotatably mounted side by side on said auxiliary shaft, and transmission means carried by said main shaft and operatively connecting said printing wheels respectively to said rotatable indexable toothed machine elements, the combination of:

a common indexing control gear wheel adapted to selectively and operatively engage said rotatable indexable toothed machine elements, a cylindrical indexing control rod parallel to said auxiliary shaft and having helical grooves formed in the cylindrical surface of said cylindrical indexing control rod, said cylindrical indexing control rod carrying said common indexing control gear wheel, a movable support rotatably carrying said cylindrical indexing control rod for movement of said rod toward and away from said auxiliary shaft, for engagement or disengagement of said common indexing control gear wheel and selected indexable toothed machine element, a structure carrying said movable support and secured to said frame, a primary shaft for indexing control constituted by a cylindrical sleeve forming a ball cage with a bore, said cylindrical control rod being capable of displacement in sliding and rotational motion within said bore of said ball cage, a bearing with a bore for receiving said rotary primary shaft, said bearing being carried by said movable support, the bore of said bearing being provided with an annular groove, balls partially engaged in said annular groove of said bearing and in said helical grooves of said cylindrical indexing control rod, an electric stepping motor carried by said structure and having a rotary shaft, universal coupling means coupling said shaft of said electric stepping motor to said rotary primary shaft, a plurality of locking arms respectively urged against the teeth of corresponding said indexable toothed machine elements, means for temporarily locking said indexing control rod solely against rotational motion, means for temporarily locking said indexing control rod solely against longitudinal sliding motion, means for temporarily thrusting back the arm for locking the indexable rotary element which is selectively disposed in meshing engagement with said common indexing control gear wheel and for angularly locking the other indexable rotary elements at the same time, and means for controlling the displacements of said support, whereby a movement of rotation of the stepping motor shaft produces either an axial displacement of the rotationally locked cylindrical indexing control rod and common indexing control gear wheel for selecting the indexable toothed machine element to be indexed or a rotational displacement of the translationally locked cylindrical indexing control rod and common indexing control gear wheel for indexing the selected indexable toothed machine element.

2. The combination of claim 1, wherein said transmission means connecting said printing wheels respectively to said rotatable indexable toothed machine elements comprise:

toothed pinions respectively secured to said printing wheels, first toothed racks mounted for longitudinal sliding motion in said main shaft and respectively in meshing engagement with said toothed pinions, and second longitudinal toothed racks respectively secured to said first toothed racks and respectively in meshing engagement with said indexable toothed machine elements.

3. A device according to claim 1, wherein the means for temporarily locking the indexing control rod solely against rotation consist of a stationary guide provided with a groove which is parallel to said indexing control rod and in which is engaged one tooth of the common indexing-control gear-wheel when said gear-wheel is not engaged against one of the indexable rotary elements.

4. A device according to claim 1, wherein the means for temporarily locking the indexing control rod solely against sliding motion consist of washers which are interposed between the indexable rotary elements and the external diameter of which is equal to the addendum-circle diameter of said rotary elements.

5. A device according to claim 1, wherein the means for temporarily thrusting-back the arm for locking the indexable rotary elements selectively disposed in meshing engagement with the common indexing-control gear-wheel and for angularly locking the other indexable rotary elements at the same time consist respectively of a projecting portion adapted to thrust-back respective extensions of the locking-arms of gear-teeth portions adapted to engage in the gear-teeth of the indexable rotary elements with which the common indexing-control gear-wheel is not engaged, said projecting portion and said gear-teeth portions being incorporated in a yoke in which the cheeks of said yoke are traversed by the indexing control rod and embrace the common indexing-control gear-wheel, said yoke being provided with a rib continuously and freely engaged in a groove of a stationary guide which is parallel to the indexing control rod.

6. A device according to claim 1, wherein the common indexing-control gear-wheel is provided with ten teeth and wherein the pitch of the helical grooves of the coupling between the indexing-control rotating primary shaft and the shaft of the stepping motor is equal to ten times the distance between the geometrical midplanes of two adjacent indexable rotary elements.

7. The combination of claim 1 wherein said movable support is pivotally mounted on said structure on an axis parallel with said cylindrical indexing control rod.

* * * * *